US005462384A

United States Patent [19]

Arlandis

[11] Patent Number: 5,462,384

[45] Date of Patent: Oct. 31, 1995

[54] SELF-CONTAINED DISPENSING BOLLARD OF VARIABLE HEIGHT

[75] Inventor: Yves Arlandis, Robion, France

[73] Assignee: 5-These Industrie, Villeneuve-les-Avignon, France

[21] Appl. No.: 256,394

[22] PCT Filed: Jan. 8, 1993

[86] PCT No.: PCT/FR93/00013

§ 371 Date: Sep. 23, 1994

§ 102(e) Date: Sep. 23, 1994

[87] PCT Pub. No.: WO93/14272

PCT Pub. Date: Jul. 22, 1993

[30] Foreign Application Priority Data

Jan. 10, 1992 [FR] France ..... 92 00278

[51] Int. Cl.[6] ..... E01F 13/00

[52] U.S. Cl. ..... 404/6; 49/49

[58] Field of Search ..... 404/6, 9, 11; 49/49

[56] References Cited

U.S. PATENT DOCUMENTS

| | | | |
|---|---|---|---|
| 3,086,430 | 4/1963 | Emmel | 404/6 |
| 3,660,935 | 5/1972 | Boots | 49/49 X |
| 4,576,508 | 3/1986 | Dickinson | 404/9 X |
| 4,666,331 | 5/1987 | Riley | 49/49 X |
| 4,715,742 | 12/1987 | Dickinson | 49/49 X |
| 4,919,563 | 4/1990 | Stice | 49/49 X |
| 5,192,159 | 3/1993 | Higginson | 404/11 |

FOREIGN PATENT DOCUMENTS

| | | | |
|---|---|---|---|
| 3812497 | 8/1989 | Austria | 49/49 |
| 0018289A1 | 10/1980 | European Pat. Off. . | |
| 0070447A1 | 1/1983 | European Pat. Off. . | |
| 0432067A1 | 6/1991 | European Pat. Off. . | |
| 2343091 | 9/1977 | France . | |

*Primary Examiner*—William P. Neuder
*Attorney, Agent, or Firm*—Bardehle & Partners

[57] ABSTRACT

The invention relates to a self-contained bollard device of variable height for dispensing electricity supplies or various fluids, the device comprising vertically movable equipment, supporting a bollard, which contains a co-axial rotary shutter. Rotation of the shutter, which is controlled by a lock with pins, presents a dispensing surface to the user or closes the window of the bollard. A single wrench-type key controls holding of the bollard in the raised or lowered positions, and also rotation of the shutter, by means of two identical locks. The bollard includes safety devices, in particular to interrupt the electricity supply when the shutter starts to rotate or the bollard starts to descend, and also in the event of a shock. The field of the invention is that of street furniture, and in particular for equipping places open to the public, such as marketplaces, camping sites, quays or piers, and service stations.

11 Claims, 2 Drawing Sheets

SELF-CONTAINED DISPENSING BOLLARD OF VARIABLE HEIGHT

The field of the invention is that of street furniture.

BACKGROUND OF THE INVENTION

The present invention provides a multifunction, self-contained, dispensing bollard device, the height of which can be varied by vertical translational movement, said bollard also incorporating technical equipment such as electricity supply sockets or plugs, or low electricity connectors, or connecting devices for various fluids. By virtue of its vertical movement, said self-contained bollard may also serve, when in its raised position, to prevent motor vehicles gaining access to certain areas and to allow access after it has been released and retracted fully into the ground.

Self-contained bollards of variable height already exist, in particular those described in French patent application No. 8717193 and in European patent application No. 90/430022.5 of Nov. 7, 1990, in the names of G. Clapier, Y. Ariandais, J-M. Alamelle and J. M. Belaval.

In those patents, the self-contained bollards of variable height are located on vehicle car parks, or on public or private roads, in order to reserve space, prevent or control access, and more generally to ensure security for users or to protect premises. The design of those bollards allows great versatility and good security for users, since in the event of a violent shock of predetermined intensity, the bollard can separate from its support, avoiding severe physical injury, as described and claimed in the cited patents.

Those same devices, which use gas springs for vertical translation, which are held in the raised and lowered positions, which are locked by a socket wrench, which have guides for the moving equipment, and which include a housing sunk into the ground and having a cover, are applicable to the multifunction technical bollards constituting the subject matter of the present invention.

OBJECTS AND SUMMARY OF THE INVENTION

A first object of the invention is therefore to provide a device which allows electrical power or various fluids to be dispersed to users located in public places or places open to the public, such as marketplaces, fairs, squares, pedestrian precincts, sports grounds, camping and caravan sites, quays or piers at marinas, airports, factory yards or service stations.

Advantageously, the self-contained dispensing bollard of the invention is retractable below ground level when its use is not required, and its mechanical strength allows any motor vehicle to pass over it when in the retracted position.

Another object of the invention is to provide a device which can deny access to the sockets or plugs—referred to as "sockets" in the following description—without requiring the bollard to be retracted. It may be useful overnight to prevent use of the sockets whilst still maintaining an obstacle which prevents intrusion onto the location concerned. Advantageously, the dispensing bollard has a window which gives access to the sockets; said window may be covered by a semi-cylindrical rotary blind, called a shutter, whose axis of rotation is the axis of the bollard itself, the shutter being operated by an authorized official using a socket wrench-type key which is inserted into a lock situated on the top surface of the body of the bollard. Advantageously, said lock, or bolt, is operated with the same socket wrench that co-operates with the lock of the device which holds the moving equipment of the bollard in the raised position or the lowered position, as described in the above-cited European patent.

Another object of the invention is to ensure the safety of the user: the rotary shutter is contained entirely within the volume of the generally cylindrical bollard, there is no risk of incorrect operation, such as a badly-closed socket shutter being torn off while the bollard is being retracted. Moreover, the functions of closing the rotary shutter and of retracting the bollard may be linked to one another or they may be independent; thus, the bollard may be retracted regardless of whether the shutter is open or closed, or if necessary the shutter may be compulsorily closed, depending on the nature of the fluids dispensed and on the related safety regulations to be complied with. The sockets are entirely contained within the cylinder of the bollard and are therefore protected against traffic collisions.

Advantageously, the bollard includes a circular cap of larger diameter than the retractable bollard. The housing for the bollard, which is sunk into the ground, and the cover are similar to those described in the cited patents. The underside of the cap carries in its rim a resilient O-ring seal which co-operates with a flat surface of the cover of the housing. Good sealing against water and dust is thereby obtained in the lowered position, particularly when public places are being cleaned by municipal employees.

The standard bollard housing, such as described in the cited patents, is sufficiently large to allow admission of the chosen fluid, for example an electric cable, with a known device for deploying the cable when the bollard is moved vertically.

Since the self-contained dispensing bollards of the invention and the access-denying bollards of the two cited patents all use the same components and are similar in appearance, they can easily be associated with one another on the same site. Thus, a marketplace may be equipped with fixed bollards, self-contained bollards of variable height that are operated semi-automatically or automatically to control access, and multi-function dispensing bollards.

Advantageously, a dispensing bollard will be provided with an inertia device of known type, such as a mercury switch or a flyweight switch, that interrupts the electrical supply upstream from the bollard in the event of impact on the bollard, whether accidental or through vandalism; and/or an upstream electricity interruption device may be provided when the bollard is partly retracted, in addition to protection being provided individually for the sockets by differential circuit-breakers.

BRIEF DESCRIPTION OF THE DRAWINGS

The present invention is shown in the drawings of an embodiment given by way of non-limiting example and in which.

MORE DETAILED DESCRIPTION

Figure 1:
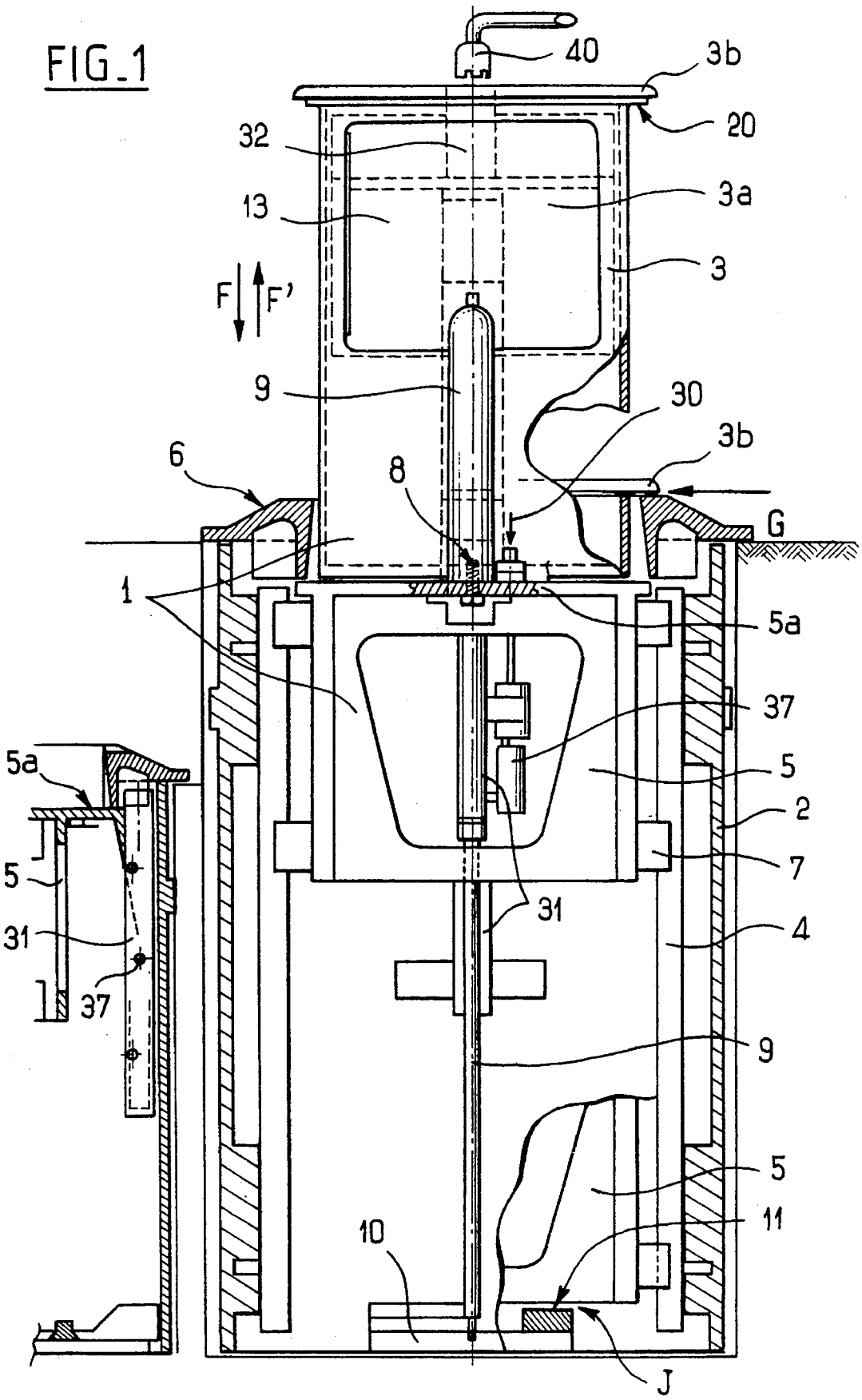
FIG. 1 is a vertical section through a complete self-contained dispensing bollard of variable height in accordance with the invention and in the raised position, with a fragmentary view on the right in the lowered position.

A self-contained dispensing bollard of variable height is shown in FIG. 1, and comprises moving equipment 1 which can be displaced in the direction of arrows F and F', within a housing 2 sunk below ground level G and advantageously of square cross-section. The moving equipment is made up of a carriage 5, supporting a bollard 3, the carriage being guided on slides such as 7 co-operating with vertical guide rails 4. The carriage 5 has a horizontal plate 5*a* on which the dispensing bollard 3 is itself secured by means of screws 8 of predetermined shear/traction strength. The housing 2 is closed at road level G by a standard cover 6, preferably of cast aluminium, and pierced by a circular bore through which the bollard can pass. The moving equipment 1, carriage and bollard, can be raised by means of an actuator or a gas spring 9, descent being instigated merely by the operator applying pressure with the foot on the top of the cap 3*b* of the bollard 3. In the retracted position, at the bottom right of FIG. 1, the carriage 5 is substantially in contact with the bottom cross-member 10 which receives the actuator 9 and is provided with resilient damping pads 11. Holding in both the raised position and the lowered position is ensured by a ratchet mechanism, by means of a holding system 31 which co-operates with the plate 5*a* in the two extreme positions of the moving equipment. A hexagonal housing wrench-type key 40, inserted in the cylindrical lock 30, pushes back pins such as 36, FIG. 4, rotating the control spindle of the rocker 37 which co-operates with two levers, at the left of FIG. 1. Each lever acts as a ratchet on the plate 5*a*, only one of the levers at a time being in the holding position. The ratchet action in the raised position is shown at the left of FIG. 1, as described in the cited patent.

Figure 2:
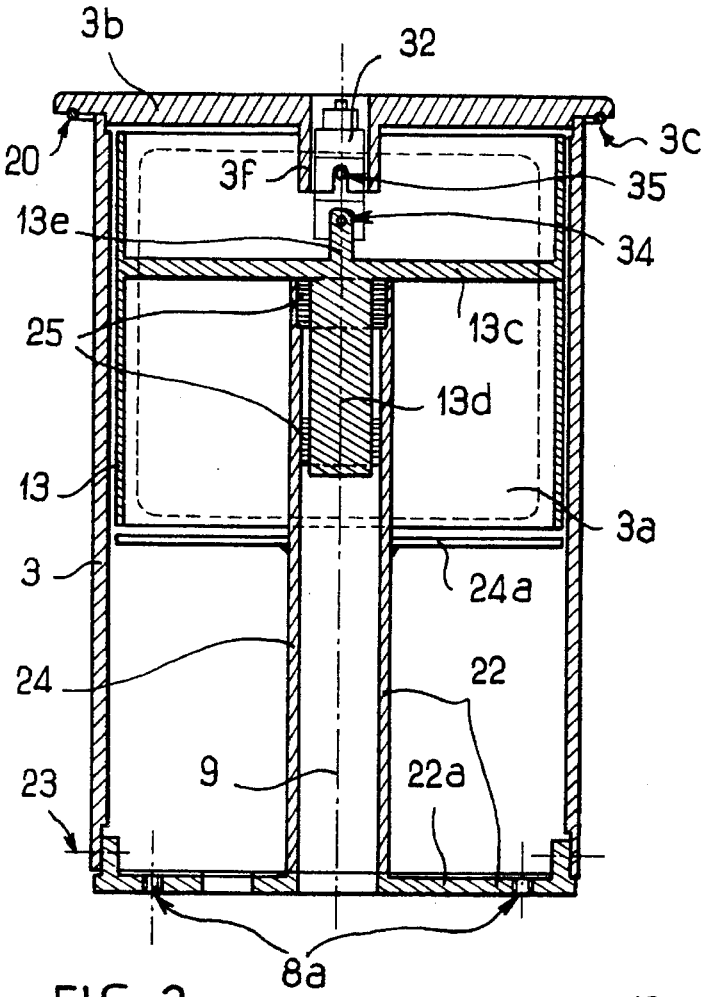
FIG. 2 is a vertical section through the bollard itself.
Figure 4:
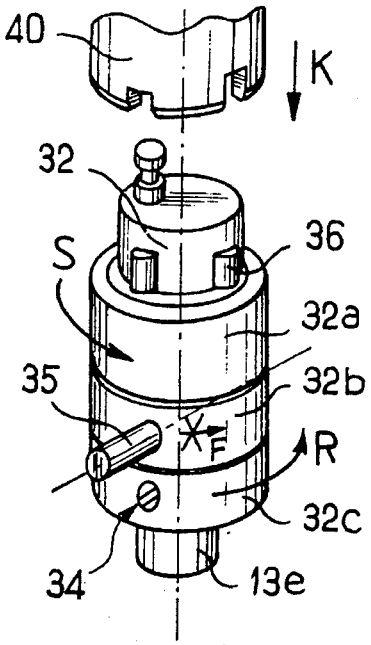
FIG. 4 shows the lock in perspective together with its wrench-type key, such as described in the cited European patent.
Figure 3:
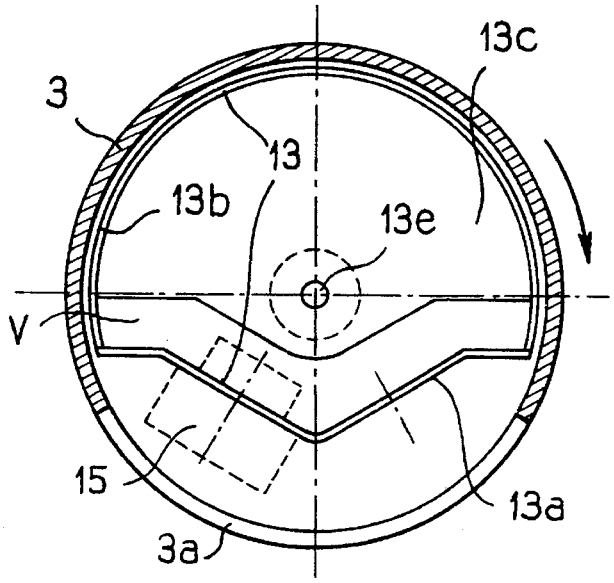
FIG. 3 is a partial view from above of the bollard and of the rotary shutter.

The dispensing bollard itself comprises a bollard body 3, FIGS. 2, 3, 4, advantageously of circular or polygonal cross-section. The body carries an integral circular cap 3*b*, of slightly larger diameter than the body. An O-ring 20 of small cross-section is received in a groove 3*c* on the underside of the rim. The body 3 is pierced by a window 3*a*, advantageously rectangular, extending over less than half of the perimeter of the bollard, FIG. 3. Inside the body there is a cooperating shutter 13, a portion 13b of which is semi-cylindrical and coaxial, rotation of the shutter either covering the window 3*a* or presenting a technical dispensing surface 13*a* to the user, for example comprising holes 14 for securing and receiving sockets such as 15.

Figure 5:
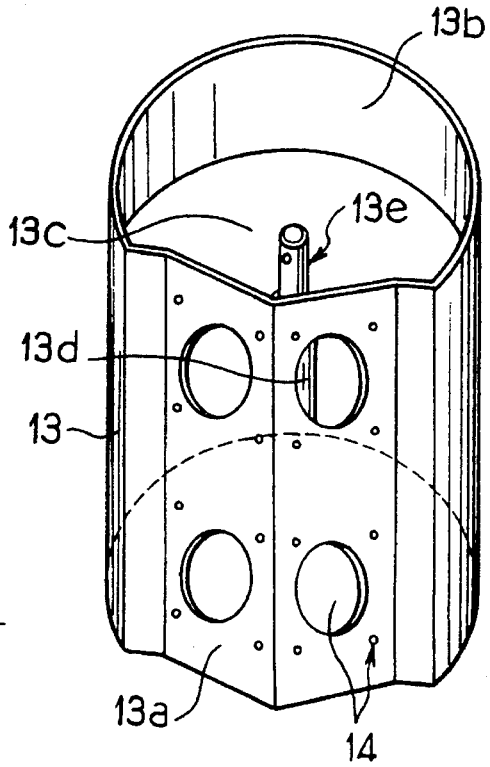
FIG. 5 shows in perspective a rotary shutter suitable for receiving electrical sockets.

Advantageously, the technical dispensing surface 13*a* has a V-shaped cross-section, FIGS. 3 and 5. The shutter 13 comprises a horizontal diaphragm 13*c*, which forms a gap V between itself and the surface 13*a*, FIG. 3. The underside of said diaphragm carries a rotary spindle 13*d* which extends as spindle 13*e* situated at the top and fitting inside the lock 32, which is identical to the lock 30 of the housing as previously mentioned. The cylindrical bollard 3 is closed at its lower portion by a horizontal base 22, comprising the closure disk 22*a* which is secured to the bollard 3 by horizontal screws 23 and which includes the two internal screw threads 8*a* which receive the screws 8 for securing the bollard on the plate. A vertical machined tube 24 is welded to the base 22, the tube carrying a web 24*a* below the window to form a blind bore. The tube 24 houses the gas spring device 9, FIG. 1. Said tube also ensures guiding and support of the rotary shutter. To this end, it is provided with rings such as 25 that are a sliding fit, the spindle 13*d* turning freely in said rings, the diaphragm 13*c* resting on the upper ring, FIG. 2.

The lock 32 which operates the shutter is located in a bore 3*f* in the cap. It is fitted onto the spindle 13*e* of the rotary shutter and held by screws such as 34, FIG. 4. The pin 35 of the lock is engaged in the slot of the bore 3*f* in the cap. As described in the cited European patent, the lock 32 comprises pins 36 which are differentially pushed down by the hexagonal housing wrench-type key 40 which has corresponding slots, so as to allow the portions 32*a* and 32*c* to rotate. The lock 32, which is identical to lock 30, FIG. 4, therefore comprises three concentric cylindrical portions of equal diameter, about 30 mm for example. The top portion 32*a* can turn in the direction of arrow S when the wrench is inserted downwards, in the direction of arrow K. The central portion 32*b* is prevented from rotating, and is therefore fixed F, by the pin 35 secured to the cap. The third bottom portion 32*c* which is secured to the shutter 13 via spindle 13*a* is caused to rotate in the direction of arrow R by the top portion 32*a* when the wrench is inserted and turned, this direction being identical to S.

The dispensing bollard may receive any kind of electrical equipment, such as sockets 15.

Operation is as follows, the bollard being initially in the retracted position in the ground:

- the O-ring 20 is compressed, small clearance J existing between 5 and 11. In one example, the electricity supply is interrupted at the bollard by any known means.
- the operator inserts the key 40 into the bollard lock 30, FIG. 1, situated in the cover 6, and turns the key.
- the bollard then rises up under the action of the actuator 9 and automatically ratchets in the raised position (see left of FIG. 1).
- the operator takes out the key and inserts it into the lock 32, then turns it in the direction of arrow S; the shutter then pivots and presents its dispensing surface 13*a* in the window 3*a*. In this position, the safety devices are de-activated and the electricity supply, for example, is established.
- the reverse operation is obvious, the electricity supply for example being interrupted at the start of the reverse rotation movement of the shutter; subsequently, the key 40, engaged in the lock 30, ensures that the holding system 31 is released by a rocking action. Merely by applying pressure on the bollard by means of a foot, the bollard is caused to descend and it is held in its lowered position.

The bollard is secured to the plate 5*a* by means of two screws 8, made of a special aluminium alloy and having a calculated diameter. Advantageously, alloys with a strength lying between that of the A-GS alloy and the 7075 THR alloy can be used. The known calculation methods for "impact of a moving vehicle on a fixed object" are applicable to the device of the invention. Experiment confirms the results of the calculation. Under the effect of a predetermined shock, the bollard resists, but in the event of a very violent impact, of predetermined magnitude, the screws, which are working in traction/shear, break; the bollard leans over and detaches itself without being thrown into the air, since it is retained by a strap or cable, not shown; the electricity supply is interrupted by a shock detector. Physical injuries are therefore reduced.

I claim:

1. A self-contained bollard device of variable height for dispensing commodities, the device comprising a vertically movable bollard inserted in a housing; an actuator which vertically moves said bollard; a ratchet mechanism using a holding system for holding the bollard in the raised and lowered positions; wherein the bollard contains a rotary shutter which covers a window in the bollard when the bollard is not in use to dispense commodities, or presents a dispensing surface which carries sockets for dispensing commodities when the bollard is in use to dispense commodities.

2. A self-contained dispensing bollard device of variable height, according to claim 1, wherein rotation of the shutter is independent of whether the bollard is in the raised or the lowered position, use of the sockets being prevented by the window being covered when the bollard is in the raised position.

3. A self-contained dispensing bollard device of variable height, according to claim 1, wherein the shutter comprises a semi-cylindrical portion 13*b* associated with a technical dispensing surface 13*a* of V-shaped cross-section, carrying means for securing the sockets 15.

4. A self-contained dispensing bollard device of variable height, according to claim 1, wherein the rotary shutter is operated by a cylindrical lock 32, with pins 36, controlled by a hexagonal housing wrench-type key 40, said key also controlling a lock 30 of the system for holding the bollard against vertical movement.

5. A self-contained dispensing bollard device of variable height, according to claim 1, wherein the bollard is closed at its lower portion by a base 22 which is fitted and screwed onto the bollard, the base comprising screw threads 8*a* which receive the screws 8 for securing the bollard onto the plate 5*a* of the carriage 5, and being provided with a vertical tube 24 housing the gas spring 9, said tube 24 also providing guiding and support for the rotary shutter.

6. A self-contained dispensing bollard device of variable height, according to claim 1, wherein the lock 32 of the shutter is secured by its base 32*c* to the spindle 13*e* of the shutter and to the cap 3*b* of the bollard, insertion of the key 40 pushing the pins down to allow the cylinders 32*a* and 32*c* secured to the shutter to rotate, the central cylinder 32*b* remaining immobilized against rotation.

7. A self-contained dispensing bollard device of variable height, according to claim 1, wherein the bollard comprises a fixed circular cap 3*b*, of larger diameter than the body, the underside of which receives an O-ring 20, which in the retracted position is compressed against the flat top surface of the cover 6, due to the clearance J formed between the carriage 5 and the dampers 11 in the lowered position, this ensuring sealing of the housing 2.

8. A self-contained dispensing bollard device of variable height, according to claim 1, wherein rotation of the shutter, in the window-covering direction, interrupts the supply of electricity before the bollard descends.

9. A self-contained dispensing bollard device of variable height, according to claim 1, wherein, regardless of whether the window is closed or open, pushing down of the bollard causes the supply of electricity to be interrupted upstream.

10. A self-contained dispensing bollard device of variable height, according to claim 1, wherein the bollard includes an inertia-type shock detection device, interrupting the electricity supply upstream from the bollard.

11. A self-contained dispensing bollard device of variable height, according to claim 1, wherein the bollard is secured to the plate 5*a* of the carriage 5 by means of screws made of an aluminium alloy, the traction/shear strength of the screws being determined by calculation, so that they break under the shock of a vehicle of predetermined mass and speed, the bollard being retained by a flexible strap or cable.

* * * * *